US009561148B2

(12) United States Patent
Friedrich

(10) Patent No.: US 9,561,148 B2
(45) Date of Patent: Feb. 7, 2017

(54) PELVIC SUPPORT, BASE SUPPORT HAVING SUCH A PELVIC SUPPORT AND METHOD TO DISTRACT AT LEAST ONE LOWER EXTREMITY

(76) Inventor: David Hugo Friedrich, Munich (DE)

( * ) Notice: Subject to any disclaimer, the term of this patent is extended or adjusted under 35 U.S.C. 154(b) by 325 days.

(21) Appl. No.: 13/523,226

(22) Filed: Jun. 14, 2012

(65) Prior Publication Data

US 2013/0006243 A1 Jan. 3, 2013

(30) Foreign Application Priority Data

Jun. 15, 2011 (DE) ..... 10 2011 104 251

(51) Int. Cl.
*A61G 13/00* (2006.01)
*A61G 13/12* (2006.01)
*A61G 13/10* (2006.01)

(52) U.S. Cl.
CPC ..... *A61G 13/0036* (2013.01); *A61G 13/123* (2013.01); *A61G 13/101* (2013.01); *A61G 13/128* (2013.01); *A61G 2203/34* (2013.01); *A61G 2210/50* (2013.01)

(58) Field of Classification Search
USPC ..... 602/30; 128/846–846, 869, 877, 882; 5/624, 621, 630, 648, 653; 297/284.2
See application file for complete search history.

(56) References Cited

U.S. PATENT DOCUMENTS 1,160,451 A 11/1915 Sanford
4,024,860 A * 5/1977 Chelnokov ..... A61F 5/04 602/32
4,930,523 A * 6/1990 Laico ..... A61F 5/04 5/87.1
5,527,309 A * 6/1996 Shelton ..... A61B 17/6425 606/55
6,311,349 B1 * 11/2001 Kazakia et al. ..... 5/624
7,060,046 B2 * 6/2006 Tanaka ..... A61F 5/0193 5/621
7,140,057 B2 * 11/2006 Hetzel et al. ..... 5/653
7,832,401 B2 11/2010 Torrie et al.
2005/0225140 A1 * 10/2005 Kneeshaw ..... 297/284.4
2007/0142191 A1 * 6/2007 Schuurmans Stekhoven ..... A63B 23/20 482/148
2011/0277246 A1 * 11/2011 Willingham ..... 5/653

FOREIGN PATENT DOCUMENTS

DE 198 29 523 A1 1/2000
DE 102005048496 A1 4/2007
DE 10 2006 007 473 A1 8/2007
EP 1364636 A1 11/2003
EP 1902700 A1 3/2008
JP 2003-000 394 A 1/2003

* cited by examiner

*Primary Examiner* — Ophelia A Hawthorne

(57) ABSTRACT

A pelvic support configured to support a pelvis and configured to take up at least one tensile stress, wherein the tensile stress is initiated in at least one lower extremity connected to the pelvis, comprising at least one support, wherein the at least one support comprises at least one supporting surface, wherein the at least one supporting surface is arranged near at least one of a ischial tuberosity of the pelvis and is configured to take up the tensile stress at the at least one ischial tuberosity.

19 Claims, 5 Drawing Sheets

PELVIC SUPPORT, BASE SUPPORT HAVING SUCH A PELVIC SUPPORT AND METHOD TO DISTRACT AT LEAST ONE LOWER EXTREMITY

TECHNICAL FIELD

Various embodiments relate generally to a pelvic support configured to take up at least one tensile stress, as well as its use; and a base support having such a pelvic support for taking up of at least one tensile stress, as well as its use; and a method for distracting at least one lower extremity by at least one tensile stress.

BACKGROUND

A distraction of a lower extremity or in other words a pulling on a lower extremity, such as for example of a leg, is necessary for some surgical and diagnostic procedures, such as reducing a fracture of a bone of the lower extremity, hip arthroscopy, hip arthroplasty or an imaging procedure. Applying a tensile stress to parts of the lower extremity will allow parts of the lower extremity, such as for example the femur, the knee, the shank and the malleolus, to be brought into a position suitable for an operation or examination. The tensile stress may also be used to pull apart the joints which connect the limbs of the lower extremity in order to allow for an operation or an examination of the joints. The words traction and distension are used synonymously for distraction.

FIG. 1 shows a base support 1 which may be used for distraction of lower extremities 2 of a person 3. The person 3 to be treated or to be examined, may be positioned supine or lateral on the base support 1 and a tensile stress or tractive force FZ is applied to one or both of the lower extremities in order to distract one or both of the lower extremities 2. The tensile stress FZ may be initiated in the trunk-distant parts of the lower extremities, for example, at the feet, the shanks or the knees of the person 3. In general, a post 4 is used between the lower extremities 2 at the pelvis of the person 3, to take up the counteracting force to the tensile stresses FZ of the person 3. The post 4 is usually implemented in a round fashion and can be made in different diameters and have an upholstery.

Applying a tensile stress FZ creates an counteracting pressure transmitted over the post 4 to the pelvis, generally to a region between the ischial tuberosities. This pressure may damage the soft tissues located near the region of post 4. Examples of soft tissue injury are: the injury of outer genitals, such as of the penis and scrotum in the case of a male or the big and small labia in the case of a female. Also, local nerves may be injured, leading to dysaesthesia in the anal region, the perineal region, the scrotum, the penis, or the labia and the clitoris. More severe injuries lead to dysfunctions of the anal sphincter and the pelvic floor musculature so that important functions, like continence and sexuality, may be impaired for longer periods, often ranging from 4 to 6 weeks, or even permanently.

The tensile stresses FZ may lead to a tilting of the pelvis, with the ischial tuberosities as fulcrum, which stops only when the inferior part of the pubic symphysis of the pelvis together with the soft tissues that are interposed between the pelvis and the post 4 are pressed hard enough against post 4 to build up a sufficient counteracting force. This can cause additional soft tissue damage of for example the above mentioned outer genitals. Tilting the pelvis can also lead to a hyperlordosis of the lower spine which may cause indistinct postoperative lumbar pains, intervertebral disc damages, increased pressure at the nerve roots, intervertebral disc protrusions or damages to joint and osseous structures of the lumbar vertebral column.

Previous attempts to reduce these complications include reducing the force, the duration of traction as well as cushioning the post 4. Unfortunately, these measures only have limited success.

An object of the invention is to provide a pelvic support which avoids complications, that may arise due to the distraction of at least one lower extremity.

SUMMARY

The invention provides a pelvic support configured to take up at least one tensile stress introduced at least at one lower extremity attached to a pelvis and such that the tensile stress is taken up about by at least one support acting on at least one of the ischial tuberosities of the pelvis. By directing the tensile stress to at least one of the ischial tuberosities, pressure damages to the soft tissues are reduced. The pressure resulting from the tensile stress is transmitted directly to the ischial tuberosities via the skin and tissues lying between the skin and the at least one ischial tuberosity and not via the soft tissues that would be damaged. The tissues lying between the skin and the at least one ischial tuberosity, in contrast to the above mentioned soft tissues, are only of little pressure sensitivity, that is, they are designed to bear great pressures without being damaged, so that relevant pressure related injuries are avoided. Thus, the pelvic support may provide a counteracting force to the tensile force via the skin, the tissues lying between the skin and the at least one ischial tuberosity. As the pelvic support remains entirely outside of the patient, no incisions or sutures are necessary, which avoids complications such as infections. The pelvic support is thus non-invasive. The term "pelvic support" also includes a pelvic fixation device, which is suited to fix the pelvis in such a way, that the abovementioned surgical and diagnostic procedures may be carried out.

In an embodiment the tensile stress is taken up solely by at least one the ischial tuberosities. Thus pressure damages to the soft tissues may be avoided.

In an embodiment the pelvic support is shaped so that no force caused by the tensile stress will act on an internal side of the ischial tuberosities or act on the lower pubic bone of the pelvis. Thus nerves which run along the internal sides of the ischial tuberosities are not affected.

In an embodiment the support is shaped so that at least one alignment of the pelvis is induced in at least one direction transverse to the tensile stress. In this manner the need for additional supports may be minimised with regard to the pelvic fixation.

In an embodiment has the support is shaped so that it may not pressed against a region between both ischial tuberosities by the tensile stress. Thus pressure is avoided on the soft parts and tissues which are in between or before the region between the ischial tuberosities, so that no pressure damages due to the effected counteracting pressure occurs.

In an embodiment the support has a convex shaped region which is convex in at least one direction, wherein the convex region extends from at least one ischial tuberosity to the other ischial tuberosity. This convex construction allows centering the pelvis in at least one direction transverse to the tensile stress.

In an embodiment the support has at least one region which is shaped concave in at least one direction, wherein at least one ischial tuberosity can be taken up in the concave region. The concave construction of the supporting part can serve the fixation of the pelvis, in at least one direction transverse to the tensile stress.

In an embodiment the concave region is shaped such, that it corresponds to the form of an ischial tuberosity. Because the concave region of the support reflects the form of the ischial tuberosity, it may be positioned more precisely on the support.

In an embodiment the support is shaped such, that it may act as a fulcrum on the lower extremity. In this manner it is possible to exert additional forces on joints or bones of the lower extremity, in order to bring the lower extremity in a certain position which could otherwise only be achieved with a higher effort or force.

In an embodiment the support extends at least from at least one ischial tuberosity to the symphysis of the pelvis. The soft parts which are situated below the symphysis are thus protected from pressure exerted by the support in case that the pelvic support should dislocate.

In an embodiment the support shows a cutout in the region of the symphysis. The cutout or recess serves to shield the interposed soft tissue, such as the outer genitals, from the pressure of the opposing force.

In an embodiment the support is composed of two separate parts, whereby each part supports a ischial tuberosity. The two-part implementation allows better access to regions of the lower pelvis and offers more fixation possibilities of the pelvis than a one-piece support.

In an embodiment the distance between the two supports is adjustable, so that the distance between two supports may be matched to the distance between the ischial tuberosities. In this manner the supports can be reduced in size, as well as allowing a more individual adjustment to the pelvic geometry.

In an embodiment includes at least one additional support which is designed to take up at least one torque and/or at least one force induced by the tensile stress. The additional support helps to avoid a tilting and/or dislocation of the pelvis from the support. Using a corresponding number of additional supports, further torques and/or forces which have an effect on the pelvis may be counteracted.

In an embodiment the at least one additional support takes up the torque and/or the force at least in one of pelvic bone, ala of the ilium, iliac crest, anterior superior iliac spine, anterior inferior iliac spine, and the pubic bone to the left and on the right of the pelvic symphysis via the skin and the subcutaneous tissues. The at least one additional support thus remain strictly outside of the patients body. The above mentioned locations have been selected to avoid pressure-sensitive soft tissues. Thus torques and forces can act on the pelvis without pressure damage to soft tissues.

Placing an additional support close to the symphysis will allow for the support to be constructed more compact, as the distance to the ischial tuberosity support is shorter than for the other mentioned locations.

In an embodiment the at least one additional support is fixed to the support. Hereby the sum of forces and/or torques which occur during a distraction may be taken up by these connected parts. Because the forces and/or torques are not passed on to the base support, demands on the mechanical properties of a base support may be reduced. Thus the base support can be made of, for example: lighter, non magnetic material, such as: plastic, aluminum or composites. This makes the base support suitable for use in imaging techniques, as such as magnetic resonance imaging (MRI) or computer tomography (CT). All parts of the pelvic support may also be made from the same materials, so that it also is suitable for use in imaging techniques, as such as magnetic resonance imaging (MRI) or computer tomography (CT). At the same time the adjustment and fixation of the at least one support and the at least one additional support on the base support is simplified and may be constructed to allow for swivelling, without changing the relationship between the position of the support and the additional support.

In an embodiment the tensile stress is taken up by only one ischial tuberosity.

In an embodiment, distraction is achieved by applying only one tensile stress to only one lower extremity.

In an embodiment at least one force sensor to measure at least one tensile stress is provided. A force sensor allows for example, to regulate the applied tensile stress, to monitor the acting forces, and help to avoid overstretched joints.

In an embodiment at least one pressure measuring matrix on at least one supporting surface of the support and/or on at least one additional support is provided. The pressure measuring matrix can be used to identify the position of the ischial tuberosities, so that the support may be optimally placed with regard to the ischial tuberosities. It may also be used to monitor the forces present.

The invention further provides the use of the pelvic support to distract at least one lower extremity.

The invention further provides a base support with a pelvic support, which has been described above.

In an embodiment the pelvic support on the base support is fixed in a swivelling fashion. This allows swivelling the pelvic support, which in turn swivels the pelvis, so that the lower extremities may be brought into an optimal position for a designated treatment or examination.

The invention further provides a method to distract at least one lower extremity by at least one tensile stress using the pelvic support described above to take up the tensile stress.

In an embodiment the person whose lower extremity is distracted is lying prone or lateral. By lying prone or lateral, some of the torques are transmitted from the pelvis and its surrounding structures directly to the base support, so that if desired, one of the additional supports may be dispensed or designed for lower forces and torques.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

Figure 8:
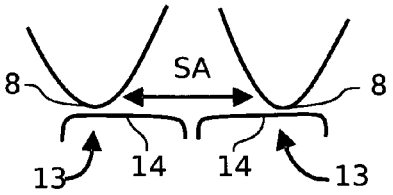
Figure 9:
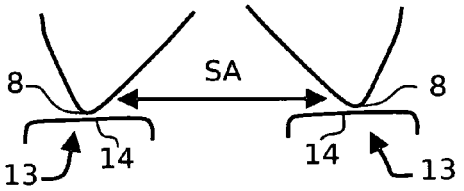
Figure 13:
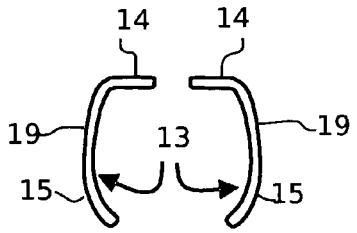
Figure 14:
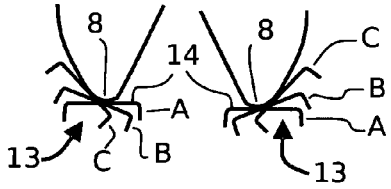
Figure 15:
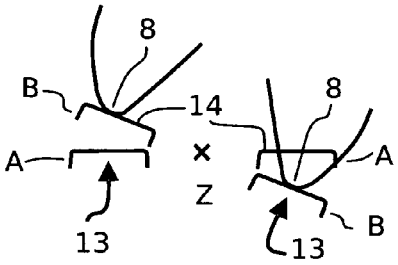
Figure 19:
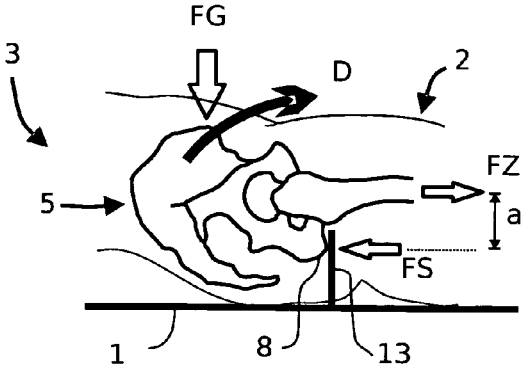

FIGS. from 5 to 7 show embodiments of one-part supports;

FIGS. 8 and 9 show embodiments of two-part supports;

FIGS. from 10 to 12 show further embodiments of two-part supports;

FIG. 13 shows an embodiment in which the supports form a lever point for the lower extremities;

FIG. 14 shows an embodiment of a two-part support where the supports are tiltable and adjustable in at least one direction;

FIG. 15 shows an embodiment of a swivelling pelvic support;

FIGS. from 16 to 18 show embodiments for the shape of two-part supports;

FIG. 19 shows forces and torques which can act on a pelvis;

FIGS. from 20 to 23 show embodiments of additional supports; and

Figure 24:
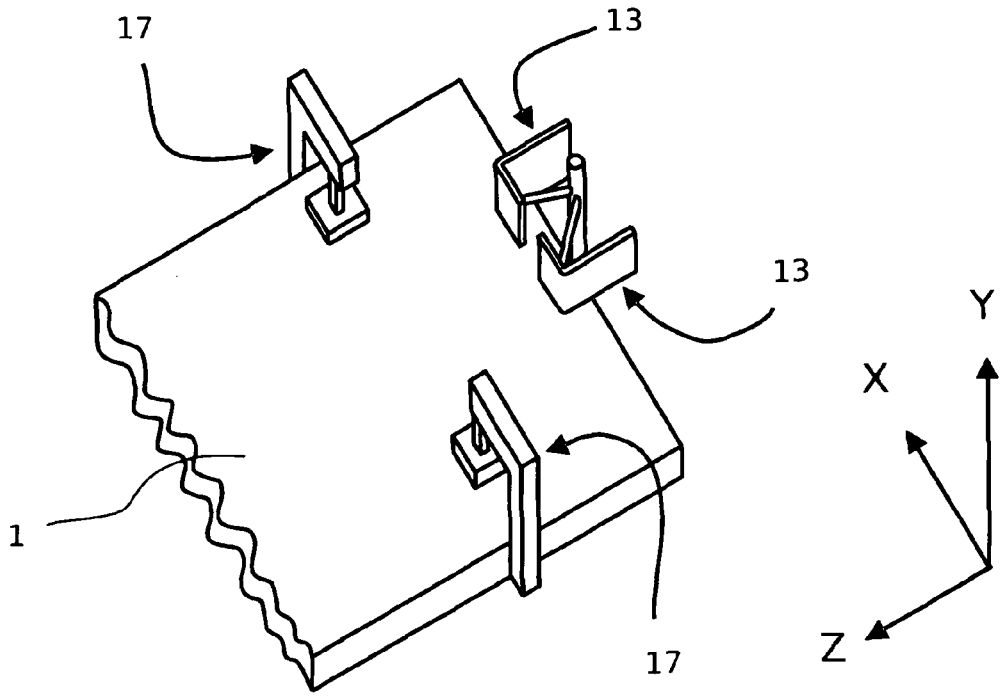

FIG. 24 shows an embodiment of a base support having a pelvic support.

DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The following expressions are used for the orientation around a body 1 of a living being:

"anterior" (medical: ventral) refers to the face of the body in which direction, for example, the abdomen is, "posterior" (medical: dorsal) refers to the back of the body in which direction, for example, the back is, "left" and "right" refer to the left and right side of the body, from the point of view of the described person. The direction in which, for example, the arms and the lower extremities leave the torso, "superior" (medical: cranial) refers to the end of the body in which direction, for example, the head is, "inferior" (medical: caudal) refers to the end of the body in which direction, for example, the lower extremities are, "near" (medical: proximal) refers to parts which are in the direction of the centre of the body, such as the heart, and "far" (medical: distal) refers to parts which are in the direction to the outer parts of the body, such as the skin, or the extremities.

Figure 2:
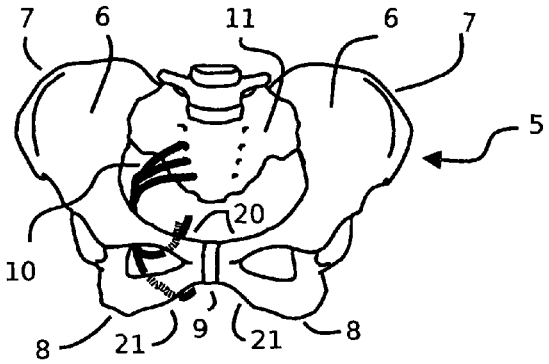
FIG. 2 shows a view of a pelvis from the front.

FIG. 2 shows a pelvis 5 in an anterior view. The pelvis 5 consists of a left and a right hip bone (Os coxae) 6 and the sacrum (Os sacrum) with coccyx (Os coccygis) 11. The hip bones 6 are connected via the sacrum 11 and the upper pubic bone (Os pubis ramus superior) 20 and the lower pubic bone (Os pubis ramus inferior) 21 via the symphysis (Symphysis pubica) 9. The pubic nerve 10 arises from the sacrum 11, and runs partly along the internal side of the lower pubic bone 21, leading for example, to the outer genitals (only the left pubic nerve is shown in FIG. 2). There a more nerves leaving the sacrum 11 leading to the anal and perineal region, which are not shown. The lower pubic bone 21 is shaped like an arch. Its most inferior parts are the ischial tuberosities (Tuber ischiadicum) 8.

Figure 3:
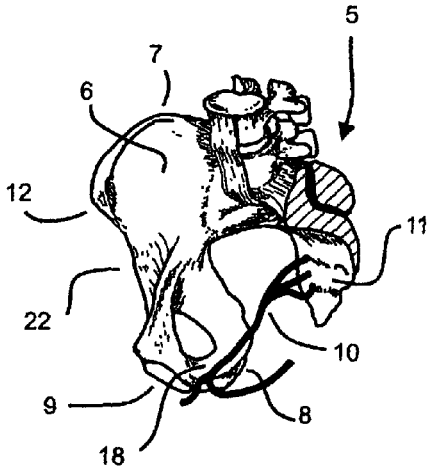
FIG. 3 shows a view of a pelvis of the side.

FIG. 3 shows the view of a pelvis 5 from the right side. The right hip bone 6 is not shown, so that the course of the pubic nerve 10 can be illustrated. The pubic nerve 10 leaves the sacrum 11 and runs on the internal side 18 of the ischial tuberosities 8 up to below the symphysis 9. The hip bone 6 has an crest (Crista iliaca) 7, an anterior superior iliac spine (Spina iliaca anterior superior) 12 and an anterior inferior iliac spine (Spina iliaca anterior inferiorly) 22.

Figure 4:
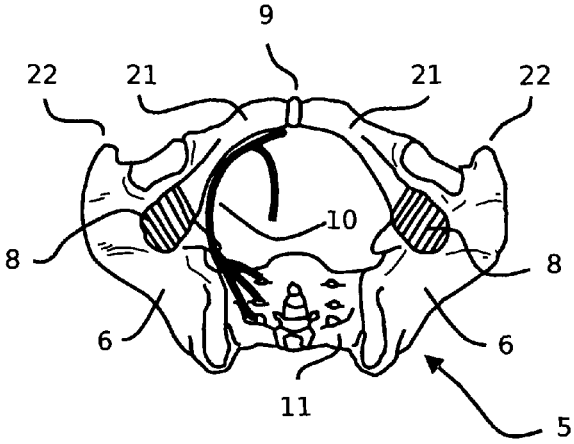
FIG. 4 shows a view of a pelvis from below.

FIG. 4 shows a pelvis 5 viewed from below showing the connection of the hip bones 6 via the symphysis 9 and the sacrum 11. The left side also shows the course of the pubic nerve 10 running from the sacrum 11 to the symphysis 9 along the lower pubic bone 21. The ischial tuberosities 8 are shown hatched. The anterior inferior iliac spines 22 are also shown.

Figure 1:
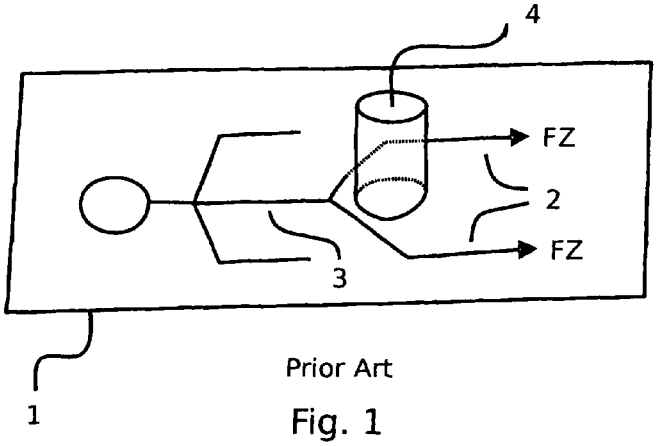
Prior Art Fig. 1
FIG. 1 shows a pelvic support.

In FIG. 1, the post 4 protrudes into the region between the two ischial tuberosities 8 and compresses soft tissues and/or nerves between the ischial tuberosities and the pubic bones like for example the pubic nerve 10 on the internal side of the lower pubic bone 21. The embodiments of the pelvic support avoid pressure damages by supporting the forces and/or torques which oppose the tractive force FZ at locations of the pelvis 5 where none of the abovementioned pressure-sensitive soft parts are. The forces and/or torques are directly applied via skin and subcutaneous tissues to the bone of the pelvis 5. These locations of the pelvis 5 are distinguished, for example, by the fact that they are to be felt easily from the outside, because they directly under the skin and no pressure sensitive soft parts lie between the skin and bony support points. Examples of such places are the ischial tuberosities 8, the iliac crest 7, the anterior superior iliac spine 12, anterior inferior iliac spine 22 and the upper border, as well as the anterior part of the symphysis 9. The pelvic support is shaped such, that the tensile stresses FZ can not induce a force resulting in pressure on the internal sides 18 of the ischial tuberosities 8 or the lower pubic bone 21 and such, that torques induced by the tensile stress do not act on the soft parts which are, e.g., between the ischial tuberosities 8 or the lower pubic bone 21.

Figure 5:
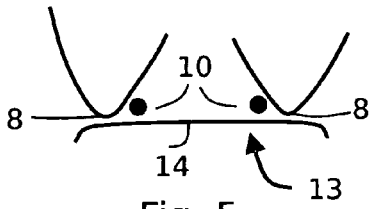

FIG. 5 shows an embodiment of the pelvic support as a one-piece support 13 where only the ischial tuberosities 8 from the pelvis 5 of FIG. 2 are shown. The tissue between the ischial tuberosities 8 and the support 13 is also not shown. FIG. 5 shows a plan view of the support along the Y direction as shown in FIG. 24, while FIG. 19, in a view along the X direction as shown in FIG. 24, shows an example how the pelvis 5, the support 13 and the base support 1, may be arranged. It is intended to support the pelvis 5 via a support 13 which has a flat supporting surface 14. The supporting force FS induced by the tensile stresses FZ is taken up directly at the ischial tuberosities 8. As the ischial tuberosities 8 are anatomically suitable to take up large compressive forces, significant pressure damages will be avoided. The flat supporting surface 14 avoids a protrusion of the support 13 into the space between the ischial tuberosities 8, so that a damage of the nerves 10 by the supporting force FS is precluded.

Figure 6:
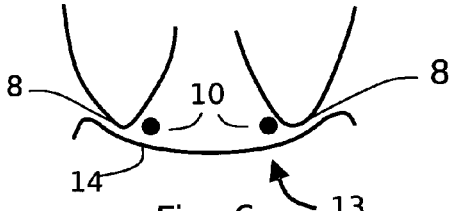

FIG. 6 shows another embodiment of a one-piece support 13 to support the pelvis, similar to what has been said about FIG. 5. In contrast to FIG. 5, the supporting surface 14 of the support 13 is shaped concave which also precludes a damage of the nerves 10 by the supporting force FS. Also, the supporting surface 14 may be shaped with different curvatures, for example, there may be an increase in curvature originating at the left and the right sides of the supporting surface 14 towards the centre of the supporting surface 14, so that a lateral fixation of the pelvis 5 takes place by a wedge effect. The supporting surface 14 may have a curvature in one direction, as in the shape of a groove, or in several directions, as in the shape of a shell. In particular, the supporting surface 14 may have a three-dimensional shape which corresponds to the contours of the ischial tuberosities 8, so that the pelvis 5 is fixed in several directions, thus decreasing the risk of a dislocation.

Figure 7:
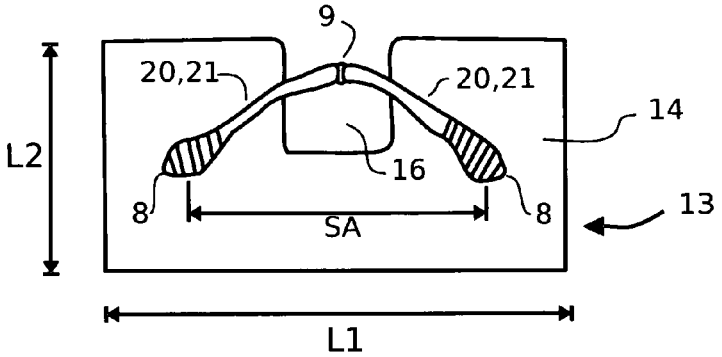

FIG. 7 shows the supporting surface 14, in a plan view along the Z direction as shown in FIG. 24, of an implementation of a one-piece support 13 as described, for example, with reference to FIG. 5 or 6. Only the lower pubic bones 21 which are connected by the symphysis 9 as well as the ischial tuberosities 8 of the pelvis 5 are shown. The supporting surface of the ischial tuberosities 8 on the supporting surface 14 is shown hatched. The support 13 is dimensioned in such a fashion, that the length L1 and the width L2 corresponds to varying distances SA between the ischial tuberosities 8 of different pelvic sizes. The dimensioning is such, that even if there is motion of the ischial tuberosities 8 on the support 13, it is ensured, that these do not leave the support 13. The support 13 shows a cutout 16 in the region of the symphysis 9. The cutout 16 is intended to circumvent pressure damages to the outer genitals by the support 13 due to a tilting of the pelvis 5 caused by the tensile stress FZ.

FIGS. 8 and 9 show embodiments of a two-part support 13. What has been said to FIG. 5 applies also here, except for the two-part implementation of the support 13. In order to account for different distances SA between the ischial tuberosities 8, the support 13 is made of two parts, where the distance between both supports 13 is adjustable and lockable. FIG. 8 shows, for example, the smaller ischial tuberosities distance SA of a male pelvis 5, while FIG. 9 shows the bigger ischial tuberosities distance SA of a female pelvis 5. Because the distance between the supports 13 is adjustable, the sum of the areas of their supporting surfaces 14 may be made smaller than the area of a supporting surface 14 in a one-piece implementation of the support 13, thus providing a better handling of the support 13 and a better access to the person 1. If the supports 13 are small in size and the distance between them is large enough, a cutout 16, as shown in FIG. 7, becomes obsolete. The two-part supports 13 as described in the following FIGS. from 10 to 13 can be adjusted and be locked in their distances to each other, as described in FIGS. 8 and 9.

Figure 10:
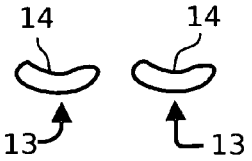

FIG. 10 shows an embodiment of a two-part support 13 whose supporting surfaces 14 are concave. In contrast to FIG. 8 the ischial tuberosities 8 are not shown, however, each ischial tuberosity 8 can be supported by a support 13. This also applies to the embodiments shown in FIGS. 11, 12 and 13.

The concave shape of the supporting surfaces 14 allows for a better fixation of the ischial tuberosities 8, so that a dislocation of the pelvis 5 is less probable. The curvature may be solely in one direction, as in the shape of a groove, or in several directions, as in the shape of a shell. A good fixation of the pelvis 5 is possible, if the supporting surfaces 14 have a shape which corresponds to the three-dimensional shape of the single ischial tuberosity 8. It is important to ensure however, that the supports 13 do not protrude into the region between the ischial tuberosities 8 where they would compress the nerves in this region, as for example the pubic nerve 10.

Figure 11:
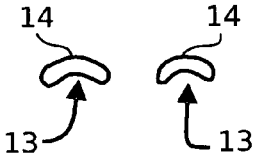

FIG. 11 shows an embodiment of a two-part support 13 whose supporting surfaces 14 are shaped convex. The supporting force FS can be concentrated on the ischial tuberosities 8 by the convex shape. However, by doing so, an additional support 17 may be necessary to avoid dislocation of the ischial tuberosities 8 from the supporting surfaces 14.

Figure 12:
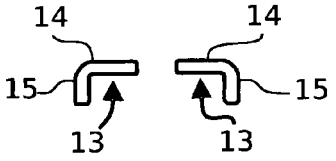

FIG. 12 shows an embodiment of a two-part support 13 with enlarged side panels 15. The side panels 15 allow a lateral fixation of the pelvis, for example, by the thighs to the left and to the right of the side panels 15. In this manner lateral dislocation of the pelvis 5 on the supports 13 may also be avoided. The transition from the supporting surfaces 14 to the side panels 15 is rounded, so that injuries to the person 3 are avoided. The side panels 15 may be also used in conjunction with the one-piece supports 13.

FIG. 13 shows an embodiment where the supports 13 are fashioned in a way, that they form lever points 19 for the lower extremities 2. The supports 13 show level supporting surfaces 14 which may be also shaped as shown in FIGS. 10 and 11. As described in connection with FIG. 12, the supports 13 have side panels 15 which are in contact with the lower extremities 2. However, these panels are longer and converge at their ends. This design provides lever points 19 at the side panels 15 which may be used to exert a force on the lower extremities 2, in vicinity to the hipjoint of the pelvis 5. If a force is applied to the lower extremity 2, as for example to a thigh, which is at a larger distance from the lever point 19 than the distance between the lever point or fulcra 19 and the joint, the exerted force results in a larger force in the joint, than if no lever points 19 is used. The fulcra may also be used to align the fragments of bone fractures. A sufficient mobility of the lower extremities 2 is ensured by the convergence of the side panels 15 at their ends. The transitions from the supporting surfaces 14 to the side panels 15 are rounded like in FIG. 12, to avoid injuries. A one-piece support 13 may be also used instead of the two-part support 13.

FIG. 14 shows an embodiment with two-part supports 13 with a tiltable mounting of supports 13. In FIG. 14 the lines marked A show the non-tilted state of the supports 13, lines marked B and C show tilted states. The supports 13 may be tiltable not only in the shown manner, but also in a second or third direction. A three-dimensional tilting may be achieved, for example, by a ball and socket joint. The tilting of the supports 13 may be lockable. Tilting the supports 13 may be used to align the supporting surfaces 14 to the contact surface of the ischial tuberosities 8, such that they are at right angles. Thus only forces arise, which are normal to the supporting surfaces 14. In this situation shear forces in the plane of the supporting surfaces 14 do not exist, so that dislocation of the ischial tuberosities 8 on the supporting surfaces 14 is minimised. Instead of implementing level supporting surfaces 14, the supporting surfaces 14, as shown in FIGS. 10 and 11 may be also used. This embodiment may also be combined with other embodiments, such as those shown in FIGS. 8, 12 and 13.

The tiltable supports 13 of FIG. 14 may also be used to fix the pelvis 5. For this, they are brought into a position shown by the lines marked C. In position C, the normal force acting on the ischial tuberosities 8 is compounded by a lateral force. By this, a swivelling or a sideways motion of the pelvis 5 may be prevented. The supporting surfaces 14 may be shaped to show a step or a bend, so that at least part of the supporting surfaces 14 is more at right angles to the tensile stress FZ, than that part of the supporting surfaces 14 which exerts the lateral force on the ischial tuberosities 8.

FIG. 15 shows an embodiment of a swivelling pelvic support which may be rotated around a centre Z. The axis of rotation may be along the Y-direction as shown in FIG. 24. Lines marked A show the non-rotated state of the supports 13, while the lines marked B show the rotated state of the pelvic support. A rotation or tilting of the pelvic support may also take place around the second or third axis of rotation and may be limited by a block. Tilting or rotating the pelvic support allows for an optimal positioning of the person 3 for the intended examination or treatment.

Figure 16:
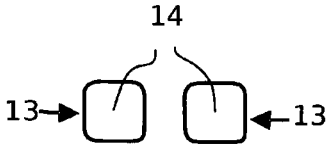
Figure 17:
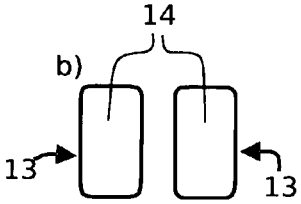
Figure 18:
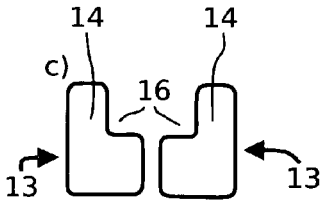

FIGS. 16 to 18 show embodiments illustrating how the supporting surfaces 14 of two-part supports 13 may be shaped. In these FIGS., the supports 13 are shown from above, as in FIG. 7, i.e. in the direction of the ischial tuberosities 8. FIG. 16 shows supports 13 with a supporting surface 14, which is just large enough to support the ischial tuberosities 8. FIG. 17 shows supports 13 which have enlarged supporting surfaces 14 compared to those in FIG.

16. The longer side of the supporting surfaces 14 is so dimensioned, that it reaches at least from the ischial tuberosities 8 up to the symphysis 9. By this, the outer genitals are protected by the supports 13, should the ischial tuberosities 8 slip on the supporting surfaces 14. FIG. 18 corresponds to the embodiments shown in FIG. 17 whereby an additional cutout 16 is provided in the region of the symphysis 8 to allow space for the outer genitals.

FIG. 19 shows the forces and torques which act on the pelvis 5 during distraction. A person 3 is shown lying supine on a base support 1. The base support 1 may be, for example, an operating table. It may also be a plate designed to be suitable for use in image acquisition, for example magnetic resonance imaging or computer tomography. The tensile stresses FZ acting on the lower extremity 2 is taken up by the support 13. The support 13 may be shaped as described above and may be connected with the base support 1. Hence, the tensile stress FZ acts on the hip 5 and the supporting force FS acts on the ischial tuberosities 8 via the skin and tissue between the skin and the ischial tuberosities 8. As there is a distance "a" between the tensile stress FZ and the supporting force FS, a torque D results, which acts on the pelvis 5. To neutralize this torque D, and thus avoid a tilting of the pelvis 5, a force FG must act on the pelvis 5 to cause a torque in the opposite direction. Hence an additional support 17 as in shown in FIG. 20 can be provided to create the opposing force FG.

Figure 20:
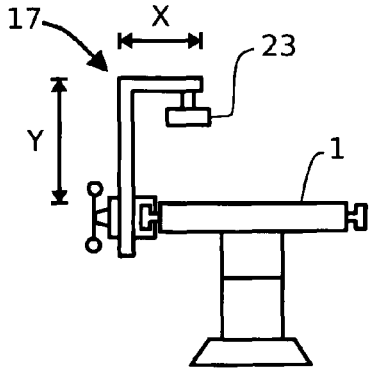

FIG. 20 shows an embodiment of an additional support 17, the directions X, Y and Z are referred to as described in FIG. 24. A base support 1, to which an additional support 17 is connected, is shown. The additional support 17 is fixed by, for example, by screwing it to a side of the base support 1, which is aligned for example along the Z axis. The additional support may also be connected to the base support 1 via a plug and socket assembly. The additional support 17 features a supporting area 23 to applying an opposing force FG on the pelvis 5. The supporting area 23 may be upholstered like the other surfaces which have contact with the body, to prevent injuries to the person. The distances y, x and z between the additional support 17 and the base support 1 may be chosen arbitrarily. In particular, the additional support 17 may be positioned in such a way, that the opposing force FG is exerted on certain areas of the pelvis 5, such as the iliac crest 7, the areas to the left and to the right of the symphysis 9, the anterior superior iliac spine 12 and the anterior inferior iliac spine 22. FIG. 20 shows the additional support 17 mounted only on one side. The supporting area 23 may be made in dimensions such that the opposing force FG, directed to the areas mentioned in the last sentence, may be exerted simultaneously to the left and right side of the pelvis 5. The additional support 17 may be also complemented with further additional supports 17 on the same or opposite side of the base support 1, where each of the additional supports 17 exerts a part of the opposing force FG on the best suited areas of the pelvis 5 as mentioned above.

If the person 3 to be examined or operated on is lying prone on the base support 1, a counter clockwise torque acts on the pelvis 5. In this position, the anterior iliac crest 7 and the anterior superior iliac spine 12 lie on the base support 1, so that a tilting of the pelvis 5 is at least partially prevented by them. In this case, the additional support 17 is provided by at least the base support 1 which is designed to take up the torque, for example, by a corresponding stiffness. A similar situation arises, if the person 3 is lying lateral on the base support 1.

Although the additional supports 17 shown in FIG. 20 can only an exert an opposing force FG in the Y direction, thus preventing a tilting/rotation of the pelvis 5 in the X-axis, it may also be fashioned in such a way, that it also prevents a tilting or rotation of the pelvis 5 in the Y- and/or the Z-axis. This allows for a stabilisation of the pelvis 5 in the Y-axis in such a manner, that distraction may be achieved by raising a tensile stress FZ on only one of the lower extremities 2. Thus, the supporting forces FS and the opposing force FG acting on the pelvis 5 during distraction, may be halved compared to the forces acting when a tensile stress FZ acts on both lower extremities 2 as in FIG. 1. It is thus likely, that pressure damages are less likely. The reduction of the acting forces allow a reduction of the mechanical demands on the base support 1 and on the device which produces the tensile stress FZ. Another advantage of the one-sided distraction lies in the fact, that in contrast to FIG. 1, the healthy lower extremity 2, which is not to be treated or to be examined, is not subjected to tensile stresses FZ, and thus its foot, knee and pelvic joints are not distracted and possibly injury by the acting forces are avoided. The additional pelvic fixation by at least one additional support 17 also allows application of the supporting force FS at only one of both ischial tuberosities 8 as induced torques may be counteract.

Figure 21:
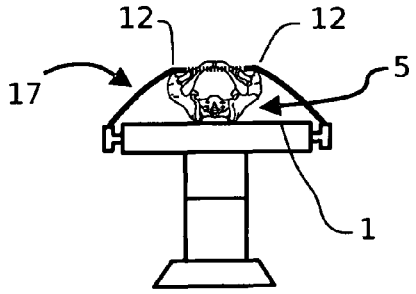

FIG. 21 shows another embodiment of an additional support 17 in which the pelvis 5 is fixed by a strap 17 on the base support 1. The strap 17 courses, for example, across the anterior superior iliac spines 12 from the left side to the right side of the base support 1 in the X direction. Thus motion of the pelvis 5 in the Y- and X-direction, as well as a tilting/rotation of the pelvis 5 in the X-axis may be limited by the strap 17. Fashioning strap 17 with a greater breadth in the Z direction, or using a second strap such that it courses in the X direction, to cross for example the anterior inferior iliac spines 22, may also prevent a tilting/rotation of the pelvis 5 along the Y-axis.

Figure 22:
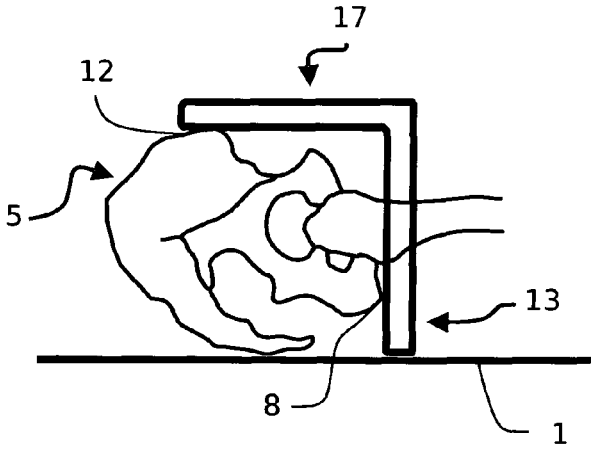

FIG. 22 shows an embodiment of an additional support 17 which is connected to the support 13. The support 13 exerts a supporting force FS on the ischial tuberosities 8, while the additional support 17 exerts an opposing force FG on the anterior superior iliac spines 12. The opposing force FG may also act on the iliac crest 7 or on the anterior inferior iliac spines 22. The additional support 17 may also be shaped such that it can act on an arbitrary combination of anterior superior iliac spines 12, iliac crest 7 and anterior inferior iliac spines 22. The torque D induced by the tensile stress FZ and the supporting force FS are thus taken up directly at the combined pelvic support, composed of support 13 and additional supports 17. The torque may thus be transmitted to the base support 1 via support 13 if it is fixed accordingly to the base support 1, for example by screw fixation. The torque may also be transmitted to the base support 1 by another additional support, e.g., by a strap from FIG. 21, where the strap passes, for example, across the anterior superior iliac spine 12 via the additional support 17. The support 13 may be also fixed at an angle to the surface of the base support 1 such that the support 13 is tilted towards the pelvis 5 to induce a wedge effect, which presses the pelvis 5 to the base support 1, thus providing additional fixation of the pelvis 5.

Figure 23:
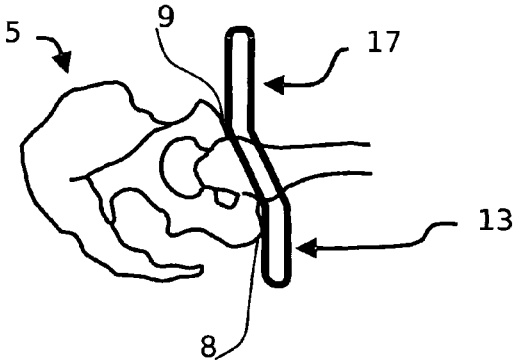

FIG. 23 shows an embodiment of an additional support 17 which is connected to the support 13 as shown in FIG. 22, so that explanations to FIG. 22 also apply to this embodiment. In contrast to FIG. 22 however, the opposing force FG in FIG. 23 acting via the additional support 17 does not act on the anterior superior iliac spines 12, the iliac crest 7 or at the anterior inferior iliac spines 22, but at the areas on the left and right of the symphysis 9 on the inferior pubic bone 21 via the skin and the underlying subcutaneous tissues at places which are suited to accept pressure forces.

FIG. 24 shows a perspective view of an assembly of a base support 1 with two-part supports 13 and additional supports 17. The directions X, Y and Z are also indicated.

The tensile stress FZ and the forces FG opposing the resultant torque D may be measured using one or several force sensors in the additional supports 17 and the supports 13, so that the lower extremities 2 may be shielded against overly large tensile stresses FZ. There may also be at least one pressure measuring matrix implemented in the supports 13 and additional supports 17, by which the acting forces may be measured. Instead of using a pressure measuring matrix, a pressure sensor may be also used. Be analysing the spatial pressure distribution as measured by the pressure measuring matrix, it is not only possible gain information about the total acting force, but, for example, also about the location of the acting forces. If for example, the pressure measuring matrix indicates a small area with high pressure, the probability is high, that the supporting force FS is acts normally, that is vertically, to the ischial tuberosities 8. If a bigger area with lower pressure is indicated however, it is likely that the supporting force FS is also acting on the soft tissues surrounding the ischial tuberosities 8. The pattern of the pressure distribution may provide information about the direction of forces which are not along the normal forces. Using this information, it is possible to position the supports 13 and additional supports 17 in such a way that soft tissue injury may be avoided.

The embodiments described above may be combined arbitrarily—as long as they do not contradict each other.

The pelvic support may be also used for other vertebrates, as for example dogs, cats, cows, horses and elephants.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

REFERENCE SIGNS 1 base support
2 lower extremity
3 person
4 post
5 pelvis
6 hip bone (Ilium)
7 iliac crest
8 ischial tuberosities
9 symphysis
10 pubic nerve
11 sacrum
12 anterior superior iliac spines
13 support
14 supporting surface
15 side panels
16 cutout
17 additional support
18 internal side of the ischial tuberosities
19 lever point
20 upper pubic bone
21 lower pubic bone
22 anterior inferior iliac spines
23 supporting area
a distance between the vectors of tensile stress and supporting force
A, B, C positions of supports
D torque
FG counteracting force on pelvis
FS supporting force on ischial tuberosities
FZ tensile stress
L1, L2 dimensions of support
SA distance between ischial tuberosities
Z fulcrum

What is claimed is:

1. A pelvic support configured to support a pelvis for surgical and diagnostic procedures and configured to take up at least one tensile stress, wherein the tensile stress is configured to be initiated in at least one lower extremity connected to the pelvis, comprising at least one support, wherein the at least one support comprises at least one supporting surface, wherein the at least one supporting surface is arranged near at least one of a ischial tuberosity of the pelvis and is configured to take up a counterforce of the tensile stress at the at least one ischial tuberosity and wherein the pelvic support is non-invasive.

2. The pelvic support according to claim 1, further comprising at least one additional support, wherein the at least one additional support is configured to take up at least one torque and/or at least one force, wherein the at least one torque and/or the at least one force is originated by the tensile stress.

3. The pelvic support according to claim 2. wherein the at least one additional support is coupled to the support.

4. The pelvic support according to claim 2. wherein the at least one additional support comprises at least one supporting area, wherein the at least one supporting area is configured to take up the at least one torque and/or the at least one force at at least one of an ilium, a wing of the ilium, an iliac crest, an anterior superior iliac spine, an anterior inferior iliac spine, and regions on the left and on the right of the symphysis of the pelvis.

5. The pelvic support according to claim 2, further comprising at least one force sensor, wherein the at least one force sensor is configured to measure at least one of the at least one tensile stress, a force acting on the at least one support and a force acting on at least one additional support.

6. The pelvic support according to claim 2, further comprising least one pressure measuring matrix, wherein the at least one pressure measuring matrix is arranged on at least one of the at least one supporting surface of the at least one support and the at least one supporting area of the at least one additional support.

7. The pelvic support according to claim 2, further comprising a base support, wherein the base support is coupled to the pelvic support and wherein the additional support is coupled to the base support.

8. The pelvic support according to claim 1, further comprising a base support, wherein the base support is coupled to the pelvic support.

9. The pelvic support according to claim 8, wherein the pelvic support is arranged on the base support in a swivelling fashion.

10. The pelvic support according to claim 8, wherein the base support is an operating table.

11. The pelvic support according to claim 1, wherein the support comprises a region, wherein the region is concave in at least one direction and wherein the region is configured to take up at least one ischial tuberosity.

12. The pelvic support according to claim 11, wherein the region that is configured to take up the at least one ischial tuberosity corresponds to a shape of the at least one ischial tuberosity.

13. The pelvic support according to claim 1, wherein the at least one support extends at least from at least one ischial tuberosity to the syrnphysis of the pelvis.

14. The pelvic support according to claim 13, wherein the support shows a cutout in the region of the symphysis.

15. The pelvic support according claim 1, wherein the support comprises two parts, wherein each part is configured to support an ischial tuberosity.

16. The pelvic support according to claim 15, wherein a distance between the two parts is adjustable and configured to be adjusted to a distance between the ischial tuberosities.

17. The pelvic support according to claim 1, wherein the support is flat and reaches at least from one of the at least one ischial tuberosity to another one of the at least one ischial tuberosity.

18. The pelvic support according to claim 1, wherein the support comprises a region, wherein the region is convex in at least one direction and wherein the convex region extends at least from one of the at least one ischial tuberosity to another one of the at least one ischial tuberosity.

19. The pelvic support according to claim 1, wherein at least one support is configured to provide a fulcrum for the lower extremity.

* * * * *